US007597540B1

(12) United States Patent
Liang

(10) Patent No.: US 7,597,540 B1
(45) Date of Patent: Oct. 6, 2009

(54) TURBINE BLADE WITH SHOWERHEAD FILM COOLING HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 357 days.

(21) Appl. No.: 11/545,000

(22) Filed: Oct. 6, 2006

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 3,533,711 | A | 10/1970 | Kercher | |
| 4,180,373 | A | 12/1979 | Moore et al. | |
| 4,456,428 | A | 6/1984 | Cuvillier | |
| 4,474,532 | A | 10/1984 | Pazder | |
| 4,770,608 | A | 9/1988 | Anderson et al. | |
| 5,062,768 | A * | 11/1991 | Marriage | 416/97 R |
| 5,165,852 | A | 11/1992 | Lee et al. | |
| 5,342,172 | A * | 8/1994 | Coudray et al. | 416/97 R |
| 5,387,086 | A | 2/1995 | Frey et al. | |
| 5,967,752 | A | 10/1999 | Lee et al. | |
| 5,975,851 | A | 11/1999 | Liang | |
| 6,139,269 | A | 10/2000 | Liang | |
| 6,273,682 | B1 | 8/2001 | Lee | |
| 6,287,075 | B1 | 9/2001 | Kercher | |
| 6,491,496 | B2 | 12/2002 | Starkweather | |
| 2006/0002796 | A1 * | 1/2006 | Bolms et al. | 416/97 R |

* cited by examiner

*Primary Examiner*—Richard Edgar
(74) *Attorney, Agent, or Firm*—John Ryznic

(57) ABSTRACT

A showerhead cooling arrangement for a turbine airfoil in which the showerhead includes a row of film cooling holes on the stagnation point of the leading edge, a row of pressure side film cooling holes, and a row of suction side film cooling holes to form the showerhead. The pressure and suction side film cooling holes eject cooling air in an upward direction of the airfoil leading edge, while the stagnation row film cooling holes eject cooling air in a downward direction in order to eliminate the film over lapping problem and yield a uniform film layer for the leading edge. In one embodiment, two rows of stagnation point film cooling holes are used to form a four hole showerhead. In other embodiments, one row or more than two rows of stagnation point cooling holes are used. In another embodiment, the stagnation point cooling holes can be two holes joined together at the mid-points.

13 Claims, 2 Drawing Sheets

TURBINE BLADE WITH SHOWERHEAD FILM COOLING HOLES

BACKGROUND OF THE INVENTION

1. Field of the Invention

The present invention relates generally to fluid reaction surfaces, and more specifically to a showerhead cooling hole arrangement for a turbine airfoil.

2. Description of the Related Art Including Information Disclosed Under 37 CFR 1.97 and 1.98

A gas turbine engine includes a turbine section with a plurality of stages of stationary vanes and rotary blades to extract mechanical energy from a hot gas flow passing through the turbine. The gas turbine engine efficiency can be increased by providing for a higher temperature of the gas flow entering the turbine. The temperature entering the turbine is limited to the first stage vane and rotor blades ability to withstand the high temperature.

One method of allowing for higher temperatures than the material properties of the first stage vane and blades would allow is to provide for cooling air passages through the airfoils. Since the cooling air used to cool the airfoils is generally bled off from the compressor, it is also desirable to use a minimum amount of bleed off air in order to improve the efficiency of the engine. The compressor performs work to compressor the bleed air for use in cooling the airfoils.

The hottest part of the airfoils is found on the leading edge. Complex designs have been proposed to provide the maximum amount of cooling for the leading edge while using the minimum amount of cooling air. One leading edge airfoil design is the showerhead arrangement. In the Prior Art, a blade leading edge showerhead comprises three rows of cooling holes as shown in FIG. 1. The showerhead arrangement 10 of the Prior Art includes a cooling air supply channel 11, a metering hole 13, a showerhead cavity 12, and a plurality of film cooling holes 14. The middle film row is positioned at the airfoil stagnation point which is where the highest heat load is found on the airfoil leading edge. The cooling hole labeled as 14 in FIG. 1 with the arrow indicates the cooling air flow is the stagnation point. The stagnation point is where the highest heat load appears on the airfoil leading edge. Film cooling holes for each row are at inline pattern and at staggered array relative to the adjacent film row as seen in FIG. 3. The showerhead cooling holes 14 are inclined at 20 to 35 degrees relative to the blade leading edge radial surface as shown in FIG. 2.

The Prior Art showerhead arrangement of FIGS. 1-3 suffers from the following problems. The heat load onto the blade leading edge region is in parallel to the film cooling hole array, and therefore reduces the cooling effectiveness. The portion of the film cooling holes within each film row is positioned behind each other as shown in FIG. 2 that reduces the effective frontal convective area and conduction distance for the oncoming heat load. Realistic minimum film hole spacing to diameter ration is approximately at 3.0. Below this ratio, zipper effect cracking may occur for the film row. This translates to maximum achievable film coverage for that particular film row to be 33% or a 0.33 film effectiveness for each showerhead film row. Since the showerhead film holes are at radial orientation, film pattern discharge from the film hole is overlapped to each other. Little or no film is evident in-between film holes.

It is therefore an object of the present invention to provide for an improved showerhead arrangement for a turbine airfoil that will use less cooling air than the Prior Art arrangement and produce more cooling of the leading edge.

BRIEF SUMMARY OF THE INVENTION

A turbine blade with a showerhead film cooling hole arrangement in which the showerhead includes a row of cooling holes at the stagnation point of the leading edge blade and a row of suction side cooling holes and pressure side cooling holes, in which the stagnation point cooling holes have an ejection direction that is not inline with the film cooling holes for the pressure and suction side rows. The stagnation row of film cooling holes ejects in a downward direction while the pressure and suction side film cooling holes ejects in an upward direction. This arrangement eliminates the film over lapping problem and yields a uniform film layer for the blade leading edge region. In addition, a double holes configuration can be incorporated for the stagnation row. The use of double hole cooling for the leading edge stagnation row will further enhance the stagnation location cooling capability. The blade showerhead arrangement of the present invention increases the blade leading edge film effectiveness to the level above the prior art showerhead arrangement of FIGS. 1-3 and improves the overall convection capability which reduces the blade leading edge metal temperature.

DETAILED DESCRIPTION OF THE INVENTION

Figure 4:
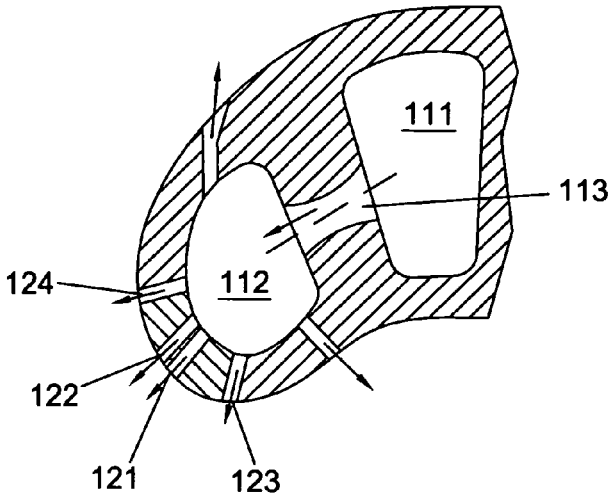
FIG. 4 shows a cross section view of the leading edge showerhead cooling holes of the present invention.
Figure 5:
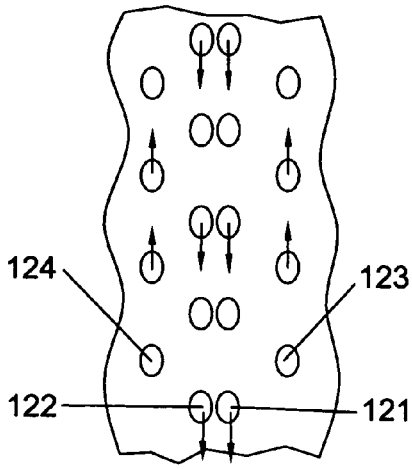
FIG. 5 shows a front view of a leading edge showerhead of the FIG. 4 showerhead arrangement of the present invention.

The present invention is a showerhead cooling hole arrangement for a leading edge airfoil used in a gas turbine engine. FIGS. 4 and 5 show the present invention. FIG. 5 shows the showerhead 10 on the leading edge of a stationary vane or rotary blade to include the cooling supply channel 112, and six film cooling holes opening onto the leading edge surface of the blade. Film cooling holes 121 and 122 are located at the stagnation point. FIG. 5 shows two rows of the film cooling holes 121 and 122 adjacent to each other at the stagnation point. The two holes 121 and 122 are located at the stagnation point such that cooling hole 121 will discharge cooling air and drift toward the pressure side while cooling hole 122 will discharge and drift toward the suction side. However, one row or three rows of cooling holes could be used along the stagnation point. Pressure side film cooling hole 123 and suction side film cooling hole 124 are located on the respective sides of the stagnation point. Two other film cooling holes are located downstream from cooling holes 123 and 124. Holes 121 through 124 form a four hole leading edge showerhead.

Figure 1:
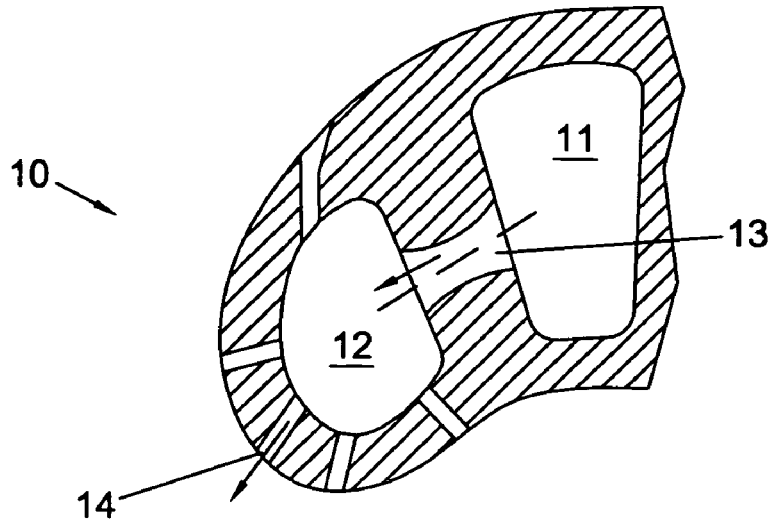
Fig 1 Prior Art
FIG. 1 shows a prior art showerhead cooling arrangement for a turbine airfoil.
Figure 2:
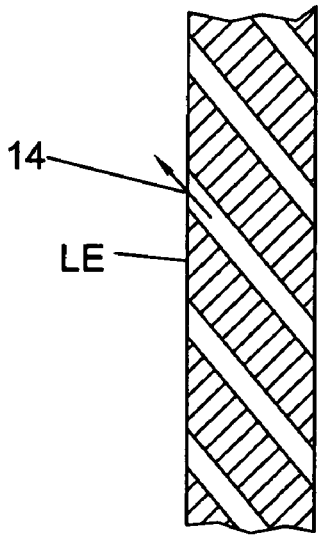
Fig 2 Prior Art
FIG. 2 shows a cross section view of the leading edge cooling holes for the prior art FIG. 1 showerhead.
Figure 3:
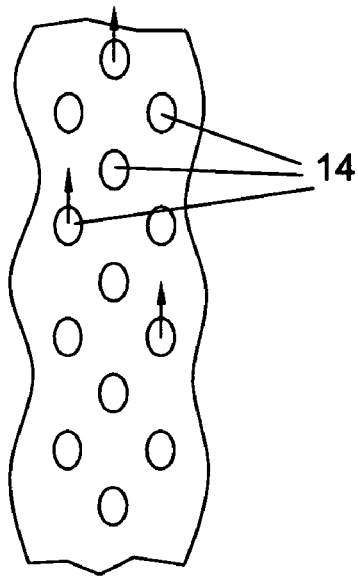
Fig 3 Prior Art
FIG. 3 shows a front view of the leading edge showerhead arrangement of the FIG. 1 prior art turbine airfoil.

FIG. 5 shows the main feature of the present invention. Film cooling holes 123 and 124 eject the cooling air in the upward direction from 20 to 35 degrees according in accordance with the cited prior art. The stagnation film cooling holes 121 and 122 eject the cooling air in a downward direction as shown by the arrows in FIG. 5. All four rows of film cooling holes 121-124 extend along the leading edge region of the airfoil along the entire spanwise direction of the airfoil. This arrangement eliminates the film over lapping problem and yields a uniform film layer for the blade leading edge region. In addition, a double holes configuration can be incorporated for the stagnation row. The use of double hole cooling for the leading edge stagnation row will further enhance the stagnation location cooling capability. The blade showerhead arrangement of the present invention increases the blade leading edge film effectiveness to the level above the prior art showerhead arrangement of FIGS. 1-3 and improves the overall convection capability which reduces the blade leading edge metal temperature.

Figure 6:
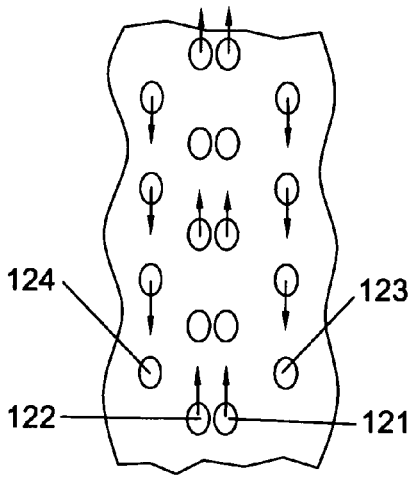
FIG. 6 shows a front view of a second embodiment of the leading edge showerhead of the present invention with the cooling hole discharge direction reversed.

FIG. 6 shows a second embodiment of the present invention in which the discharge direction of the stagnation point film cooling holes 121 and 122 of FIG. 5 are reversed. In the FIG. 6 embodiment, the stagnation point film cooling holes 121 and 122 discharges the cooling air in the upward direction while the pressure and suction side cooling holes 123 and 124 discharge the cooling air in the downward direction.

Figure 7:
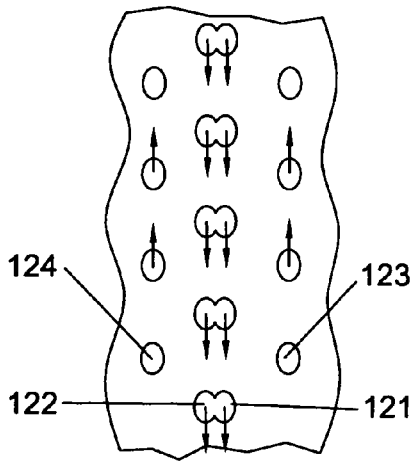
FIG. 7 shows a front view of a third embodiment of the present invention in which two holes is joined together.

A third embodiment of the present invention is shown in FIG. 7 in which the two separate stagnation point cooling holes of FIG. 5 are joined together such that cooling air in one hole 121 can flow into the other cooling hole 122. A sideways figure 8 is formed within the film cooling holes 121 and 122 when joined. As in the FIGS. 5 and 6 embodiments, the discharge direction of the cooling holes 121 through 124 can be reversed in the upward and downward direction. The joined cooling holes 121 and 122 are positioned at the stagnation point such that cooling air discharged from hole 121 will drift toward the pressure side and cooling air discharged from hole 122 will drift toward the suction side.

Cooling air is supplied into a cooling supply channel 111 and through a plurality of impingement holes 113 and into the impingement cavity 112 of the leading edge. One long impingement cavity could be used, or a plurality of separate impingement cavities could be used in the present invention. The impingement cavity 112 directs the cooling air through the film cooling holes connected to the cavity.

The showerhead film cooling hole arrangement of the present invention is intended to be used in a blade cooling design of a gas turbine engine, and especially for a high temperature blade application with high leading edge film effectiveness requirements.

I claim:

1. A turbine airfoil with a showerhead arrangement to provide cooling for the leading edge of the airfoil, the airfoil having an impingement cavity to deliver cooling air to film cooling holes forming the showerhead, the showerhead arrangement comprising:

a first row of film cooling holes located in a stagnation point on the leading edge of the airfoil, the first row of cooling holes having an ejecting direction in one of an upward direction and a downward direction;

a second row of film cooling holes adjacent to the first row and on the pressure side of the leading edge;

a third row of film cooling holes adjacent to the first row and on the suction side of the leading edge;

the second and third row of film cooling holes having an ejecting direction in the other of the upward and downward direction opposed to the first row direction; and, the three rows of film cooling holes each extends along substantially all of the airfoil surface in a spanwise direction.

2. The turbine airfoil of claim 1, and further comprising:

the first row of film cooling holes includes only two rows.

3. The turbine airfoil of claim 2, and further comprising:

the two rows are relatively closely spaced.

4. The turbine airfoil of claim 2, and further comprising:

the two rows are joined together.

5. The turbine airfoil of claim 4, and further comprising:

the two joined rows have a figure 8 cross sectional shape along the axis of the holes.

6. The turbine airfoil of claim 2, and further comprising:

the pressure side row of the first row stagnation point cooling holes discharges cooling air toward the pressure side; and, the suction side row of the first row stagnation point cooling holes discharges cooling air toward the suction side.

7. A process for cooling a leading edge of a turbine airfoil, the leading edge having a showerhead arrangement to discharge film cooling air from a cooling supply cavity within the airfoil, the process comprising the steps of:

discharging cooling air from a first row of film cooling holes located at a stagnation point on the leading edge in either an upward direction or a downward direction;

discharging cooling air from a second row of film cooling hole adjacent to the first film row of cooling holes and on the pressure side of the leading edge in the upward or downward direction opposite to the first row of film cooling holes;

discharging cooling air from a third row of film cooling holes adjacent to the first row of film cooling holes and on the suction side of the leading edge in the direction of the second row of film cooling holes; and, extending the first row, the second row and the third row of film holes along the airfoil surface from the root to the tip.

8. The process for cooling a leading edge of a turbine airfoil of claim 7, and further comprising:

the step of discharging cooling air from a first row of film cooling holes includes discharging cooling air through two adjacent film cooling holes in which the pressure side hole discharges toward the pressure side and the suction side film cooling hole discharges toward the suction side.

9. The process for cooling a leading edge of a turbine airfoil of claim 8, and further comprising the step of:

the two adjacent film cooling holes are connected together.

10. A turbine rotor blade comprising:

a root section with a platform;

an airfoil section extending from the root section;

the airfoil section having a leading edge with a pressure side wall and a suction side wall extending from the leading edge to define the airfoil section;

a showerhead arrangement of film cooling holes connected to a cooling air supply cavity internal to the airfoil section;

the showerhead film cooling holes including two rows of film cooling holes located in a stagnation point of the leading edge and each row of film cooling holes directed to only discharge film cooling air toward the platform end of the airfoil; and, the showerhead film cooling holes including a row of film cooling holes on the pressure side and on the suction side of and adjacent to the stagnation point both rows of film cooling holes directed to only discharge film cooling air toward the blade tip end of the airfoil;

the rows of showerhead film cooling holes each extending along the entire airfoil surface from adjacent to the platform to a blade tip region.

11. The turbine rotor blade of claim 10, and further comprising:

the two rows of film cooling holes along the stagnation point are separate film cooling holes.

12. The turbine rotor blade of claim 11, and further comprising:

the two rows of film cooling holes along the stagnation point are closely spaced from one another.

13. The turbine rotor blade of claim 10, and further comprising:

the two rows of film cooling holes along the stagnation point are connected film cooling holes that form a figure 8 cross section.

* * * * *